United States Patent [19]

Jeppson

[11] Patent Number: 4,594,022

[45] Date of Patent: Jun. 10, 1986

[54] PAVING METHOD AND PAVEMENT CONSTRUCTION FOR CONCENTRATING MICROWAVE HEATING WITHIN PAVEMENT MATERIAL

[75] Inventor: Morris R. Jeppson, Carmel, Calif.

[73] Assignee: MP Materials Corporation, Carmel, Calif.

[21] Appl. No.: 613,518

[22] Filed: May 23, 1984

[51] Int. Cl.[4] ..... E01C 3/00; E01C 7/06

[52] U.S. Cl. ..... 404/28; 404/31; 404/77; 404/79; 404/82

[58] Field of Search ..... 404/17, 27, 28, 31, 404/70–72, 79, 82, 95, 77

[56] References Cited

U.S. PATENT DOCUMENTS

| | | | |
|---|---|---|---|
| 2,347,233 | 4/1944 | Abernathy | 117/30 |
| 2,408,251 | 9/1946 | Dantz | 404/28 |
| 3,603,221 | 9/1971 | Barton | 117/30 |
| 4,175,885 | 11/1979 | Jeppson | 404/77 |
| 4,252,459 | 2/1981 | Jeppson | 404/77 |
| 4,252,487 | 2/1981 | Jeppson | 404/77 |
| 4,319,856 | 3/1982 | Jeppson | 404/79 |

OTHER PUBLICATIONS (Author not identified), "Late Night Operation Replaces Deck . . . ", California Builder & Engineer, Nov. 29, 1982, pp. 28, 30.

Advertisement of Phillips Fibers Corporation, Rural and Urban Roads, Sep. 1977, for "PETROMAT", p. 57.

Advertisement of Greulick, Inc., Rural and Urban Roads, Aug. 1978, p. 21, headed "A New Deck in Seven Weeks . . . ".

*Primary Examiner*—Stephen J. Novosad
*Assistant Examiner*—John F. Letchford
*Attorney, Agent, or Firm*—Phillips, Moore, Lempio & Finley

[57] ABSTRACT

A microwave energy reflecting zone (12, 12*a*, 12*b*) is provided below the surface of a pavement (11, 11', 11*a*, 11*b*) at a depth that is less than the maximum depth that such energy can penetrate into paving materials. The reflective zone, which is formed of electrically conductive material (16, 16*a* to 16*h*), results in energy and cost savings in subsequent paving or pavement repair operations that involve microwave heating of thermoplastic pavement and in which it is not necessary to heat down to the full depth to which such energy can penetrate paving materials. The heating is concentrated or localized within a predetermined upper portion of the pavement. The energy concentrating pavement may, for example, be more economically resurfaced when that becomes necessary by microwave heating followed by remixing and recompaction of the heated upper portion of the pavement material. The microwave reflective zone may be arranged to transmit a limited portion of downwardly propagating microwave energy to assure good bonding of the heated overlayer to the underlayer of paving material. Different microwave heating patterns, ranging from a highly uniform heating to heating which increases with depth, may be arranged for by locating the reflective zone at different depths.

23 Claims, 11 Drawing Figures

PAVING METHOD AND PAVEMENT CONSTRUCTION FOR CONCENTRATING MICROWAVE HEATING WITHIN PAVEMENT MATERIAL

TECHNICAL FIELD

This invention relates to pavement technology and more particularly to a paving method, pavement heating method and pavement construction which provide for more efficient use of microwave heating in paving and pavement repair operations.

BACKGROUND OF THE INVENTION

Roads and other pavements formed of asphaltic concrete or the like require repair, which may include resurfacing, after a period of use. Overlaying such pavements with new asphaltic concrete is costly. Petroleum based asphalt is itself expensive and transporting new paving material from a distant hot mix plant or the like adds substantially to costs.

Economies may be realized by recycling the original paving materials on site. A roadway or the like may be resurfaced by heating the deteriorated pavement or at least the upper portion of the pavement to soften the asphalt binder and by then remixing and recompacting the heated material. Small areas containing cracks, potholes or the like may be repaired by an essentially similar technique.

It is highly advantageous to utilize microwave heating in such resurfacing or repair operations. Microwave energy instantly penetrates most paving materials, typically to depths of about 20 centimeters, and generates heat within the penetrated material in the process. The pavement is heated more deeply, rapidly and uniformly than is practical if older techniques, which apply externally produced heat to the pavement surface, are employed. Methods and apparatus for heating pavements in place with microwave energy are described in my prior U.S. Pat. Nos. 4,319,856; 4,175,885; 4,252,459 and 4,252,487.

In some paving resurfacing or repair operations it is not necessary to heat and remix the asphaltic pavement down to the full depth to which microwave energy penetrates into pavements. A more economical reworking of just the top several centimeters may be sufficient. Unnecessarily deep microwave heating of the pavement and/or underlying material in such circumstances unproductively consumes costly energy.

Known techniques for controlling the depth of heating in paving or paving repair operations are not effective in the case of microwave heating. Older heating techniques rely on the downward thermal conduction of externally generated heat that is applied to the pavement surface. Depth of heating is affected by adjustment of the rate at which such heat is applied to the pavement surface or by varying the length of time during which the heat is applied. Neither of these procedures is effective for controlling the depth of direct heating of paving material by microwave energy.

Microwave energy, which is not itself heat, is a form of electromagnetic energy that instantly penetrates into dielectric materials and is then converted to heat within the penetrated region of the material. The efficiency of this conversion, for microwave energy of a specific frequency, is dependent on the molecular structure of the penetrated material and is not significantly affected by other factors. Thus the depth of penetration of the microwave energy remains essentially the same regardless of the rate at which it is applied or the duration of the period during which it is applied. Varying the intensity of the microwave energy or varying the period during which it is applied changes the degree of heating but does not significantly change the penetration depth of the microwave energy.

Paving operations of the kind described above would be more efficient and economical if microwave heating could be concentrated or localized at a predetermined region thereby avoiding unnecessarily deep heating of the pavement or underlying material.

The present invention is directed to overcoming one or more of the problems set forth above.

SUMMARY OF THE INVENTION

In one aspect of the present invention, a paving method is provided wherein an overlayer of microwave absorbent thermoplastic paving material is laid over an underlayer of material that is also penetratable by microwave energy, the overlayer having a thickness that is less than the maximum thickness of thermoplastic paving material that can be penetrated by microwave energy. The method includes the further step of forming a microwave energy reflective zone between the overlayer and the underlayer that will reflect at least a portion of downwardly propagating microwave energy back up into the overlayer.

In another aspect, the invention provides a method of repairing pavement, at least the upper portion of the pavement being microwave absorbent thermoplastic concrete and in which the material below the upper layer is also penetratable by microwave energy, which includes the steps of directing microwave energy downwardly into the pavement to generate heat within the pavement, concentrating the heating within the upper layer of the pavement by reflecting at least a portion of the microwave energy back upwardly at a predetermined depth below the surface of the pavement that is less than the maximum distance that microwave energy can penetrate into thermoplastic concrete, and recompacting the heated material of the upper layer of the pavement.

In still another aspect, the invention provides a pavement in which at least an upper layer of the pavement is formed of microwave absorbent thermoplastic paving material and the material below the upper layer is also of a type into which microwave energy can penetrate, the upper layer having a thickness that is smaller than the maximum distance that microwave energy can penetrate into paving materials. The pavement further includes a microwave energy reflective zone located between the upper layer and the lower material, the zone being defined by a relatively thin expanse of electrically conductive material between the upper layer and lower material and which has a configuration that will reflect at least a portion of downwardly propagating microwave energy back up into the upper layer.

The invention provides a pavement which can be more economically resurfaced or otherwise repaired by techniques which include microwave heating followed, in many cases, by scarifying or remixing or other reworking of the heated material and after which the pavement may be recompacted. The presence of a microwave reflective zone of metal or the like at a predetermined depth below the surface of a thermoplastic pavement acts to concentrate or localize such heating within the material above the zone. Unnecessarily deep heating and consequent energy wastage is avoided. In some forms of the invention, the reflective zone may be configured to transmit a limited portion of downwardly penetrating microwave energy to provide for some heating of the immediately underlying material to assure good bonding with the reworked overlayer or for other purposes. It is also possible to establish different temperature distributions in the upper layer of pavement in response to microwave heating by selection of the depth of the reflective zone below the pavement surface. The invention may be utilized in the laying of new pavements in order to facilitate future repair when that becomes necessary, and existing pavements may also be reconstructed in accordance with the invention for similar purposes.

DETAILED DESCRIPTION OF PREFERRED EMBODIMENTS

Figure 1:
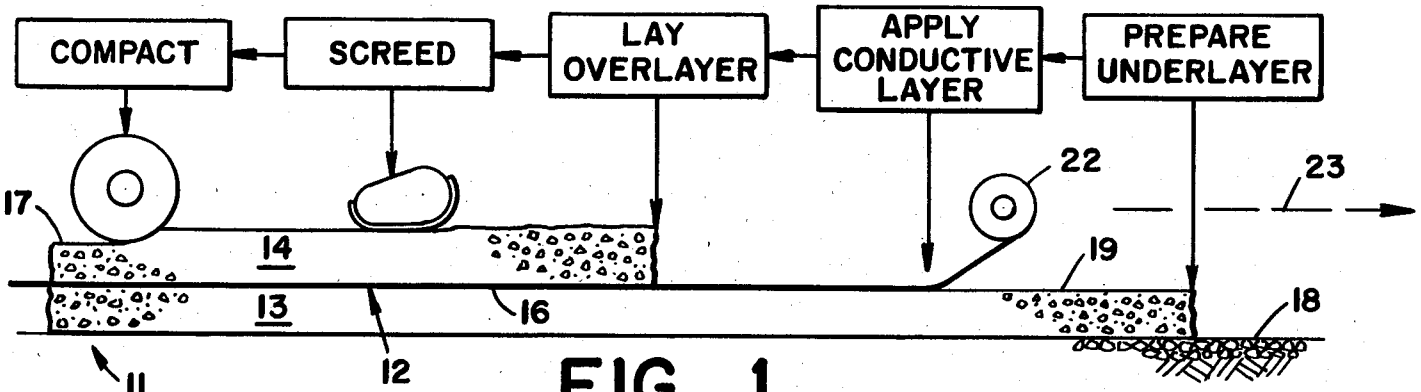
FIG. 1 is a diagrammatic illustration of successive steps in a paving method for constructing a pavement in accordance with an embodiment of the invention.

Referring initially to FIG. 1 of the drawings, a typical pavement 11 embodying the invention has a microwave energy reflective zone 12 situated between a lower or underlayer of pavement 13 and an upper or overlayer of pavement 14. The microwave reflective zone 12 is defined by a relatively thin layer 16 of electrically conductive material such as aluminum or other conductive metal and may have a number of different configurations as will hereinafter be discussed in more detail.

Overlayer 14 is formed of thermoplastic, microwave absorbent paving material, such as asphaltic concrete for example, the term thermoplastic being herein used to refer to pavements which can be decomposed into a softened or semi-liquid state by heating and which can then be reworked and recompacted.

Underlayer 13 is also formed of microwave absorbent paving material but need not necessarily be thermoplastic. Thus the underlayer 14 may variously be asphaltic concrete or Portland cement concrete, brick, stone or, in the case of thin light duty pavements, base material such as gravel sand or packed earth. With a few exceptions, such as pure quartz, paving material that contains rock or rock particles is strongly absorbent or microwave energy and can be efficiently heated by such means.

Microwave energy penetrates into absorbent paving materials of the above discussed kind for a distance of about 7½ inches (20 cm) before being essentially fully absorbed although there is some variation dependent on the specific composition of the particular material. The microwave reflective zone 12 of pavement 11 is located a predetermined distance below the top surface 17 of the pavement that is less than this maximum penetration distance so that upon microwave irradiation of the pavement the zone will reflect downwardly propagating energy back up into the overlayer 14 as will hereinafter be described in more detail.

Initial steps in a paving method for forming the microwave energy concentrating pavement 11 include preparation of the underlayer 13. This may involve different operations depending on whether the roadbed 18 or other site is initially unpaved or already has a pre-existing pavement that is to be embodied into the microwave concentrating pavement 11. In the case of an entirely new pavement 11, the underlayer 13 may be laid in place by known paving techniques and as previously pointed out may variously be formed of asphaltic concrete, Portland cement concrete or other microwave absorbent materials used in paving operations. The upper surface 19 of underlayer 13 is situated below the desired final top surface 17 of the pavement 11 to provide for the subsequent laying of overlayer 14.

If pre-existing pavement is to be used to form the underlayer 13, preparation of the underlayer may vary depending the condition of the old pavement and on the final thickness of pavement 11 that is desired to provide adequate load bearing capacity and wear resistance. If the pre-existing pavement is in good condition and it is desired to form a thicker and higher final pavement 11, debris may be cleared from the old pavement and the hereinafter described operations may then proceed. More typically, the old pavement surface may exhibit cracks, ruts, potholes and the like which should be filled or, in the case of thermoplastic concrete pavements, at least the upper portion of the old pavement should be heated, remixed and recompacted. One advantageous technique for resurfacing deteriorated thermoplastic concrete utilizing microwave heating is described in my prior U.S. Pat. No. 4,319,856.

Figure 2:
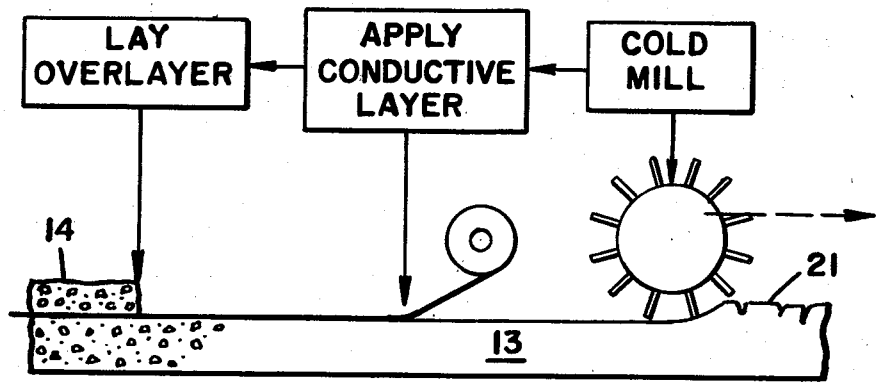
FIG. 2 is a diagrammatic illustration of successive steps in a method for reconstructing pre-existing pavement in accordance with another embodiment of the invention.

If the pre-existing pavement approaches or exceeds the desired final thickness of the microwave concentrating pavement 11, preparation of the underlayer 13 may include removal of an upper portion 21 of the old pavement as depicted in FIG. 2 by cold milling or other known techniques. Such removal of an upper portion of the old pavement enables the original surface elevation of the pavement to be preserved when that is required. Removal of the upper portion 21 is also advantageous in many instances where preservation of the original level may not be necessary. For example, the upper portion 21 of old pavement is often the most deteriorated portion. If the old pavement is thermoplastic, substantial economies in the paving method may be realized by removing the deteriorated upper portion 21 and then utilizing the removed material to form the overlayer 14 by heating, remixing and recompacting such material preferably at or in the vicinity of the paving operation.

Referring again to FIG. 1, preparation of the underlayer 13 may also include application of a tack coat of hot liquid asphalt or other binders and sealants to the top surface of the underlayer.

The above described operations are followed by application of electrically conductive material 16 to the surface of underlayer 13 to form the microwave reflective zone 12. The conductive material 16, which may be aluminum, steel or other conductive metal for example, is arranged to form an electrically conductive layer between underlayer 13 and overlayer 14.

The microwave reflective zone 12 may be formed as a continuous layer of such conductive material 16 or may be formed with spaced apart openings having dimensions smaller than the wavelength of the microwave energy which will be used to heat the pavement in subsequent repair operations. Openings which are substantially smaller than the wavelength do not transmit microwave energy. Openings with dimensions more closely approaching the wavelength may transmit a limited amount of microwave energy and this may be advantageous in some instances as will hereinafter be described in more detail.

Insofar as the desired electrical properties are concerned, the reflective zone 12 may be extremely thin in relation to the overlayer 14 or underlayer 13. In order to reflect microwave energy, the zone 12 need be no thicker than the electrical skin depth of the conductive material 16. Such skin depths in many conductive metals are considerably smaller than one millimeter. As a practical matter, somewhat greater thicknesses of the material 16 are usually desirable to assure structural integrity or a very thin layer of metal may be adhered to a non-conductive backing material such as flexible sheet plastic as will hereinafter be described in more detail.

Thicker layers of the conductive material 16 may be used in instances where it is desired that the material provide structural reinforcement to the pavement 11 as well as serving to reflect microwave energy. In this connection, the steel reinforcing bars or rebars commonly found in Portland cement concrete highways or the like do not reflect microwave energy at least to an extent adequate for the present purposes. Openings between such rebars typically exceed the dimensional limitations hereinbefore discussed and there may be little or no electrical conductivity between such rebars at the points of intersection. Tests have shown that a typical gridwork of such rebars, having openings measuring about 4 inches (10.2 cm) by 18 inches (45.8 cm), is essentially transparent to 915 MHZ microwave energy.

In those cases where the conductive material 16 is a sheet or mesh of sufficient thinness to be flexible, it is advantageous to unroll the material from a spool or drum 22 as operations progress in the direction of arrow 23 along the roadbed 18 or the like. Spool 22 may be moved manually or may be supported on a paving vehicle and be power driven.

Following the steps described above, overlayer 14 is laid over the reflective zone 12 and is then screeded and compacted to form the final pavement 11. Another tack coat of liquid asphalt or the like may be applied to the surface of reflective zone 12, prior to laying overlayer 14 in order to promote bonding. The overlayer 14 may be laid by known techniques and by utilizing known equipment. My prior U.S. Pat. No. 4,252,459 describes an energy conserving paving method and apparatus utilizing microwave heating which can advantageously be used to form the overlayer 14 although other paving processes and apparatus may also be used.

The overlayer 14 may be formed of new paving material but cost savings may be realized by heating and remixing old thermoplastic pavement and utilizing such recycled material, in whole or in part, to form the overlayer. For example, if a surface portion 21 of the underlayer 13 has been removed as previously described with reference to FIG. 2 and the underlayer is thermoplastic, then the removed material may advantageously be used in whole or in part to form the overlayer 14.

Referring again to FIG. 1, the overlayer 14 is typically formed to have a vertical thickness between about 2 and 5 inches (5 and 13 cm) although some variation from these limits may be appropriate in some cases depending on the particular paving materials and the usage to to which the pavement is to be put. In any case, the overlayer 14 thickness is less than the maximum penetration distance of microwave energy into the overlayer material but sufficient to provide for subsequent heating, remixing and recompaction of the overlayer, when it becomes deteriorated, without disruption of the microwave reflective zone 12. Selection of the thickness of overlayer 14 may also be determined by the fact that different temperature patterns in response to microwave heating can be produced by locating the reflective zone 12 at different depths within this range as will be hereinafter described in more detail.

The advantage of the above described paving method and pavement 11 is that the pavement can be much more economically resurfaced or otherwise repaired, when that eventually becomes necessary, by methods which include the use of microwave energy to reheat an upper region of the pavement.

Figure 3:
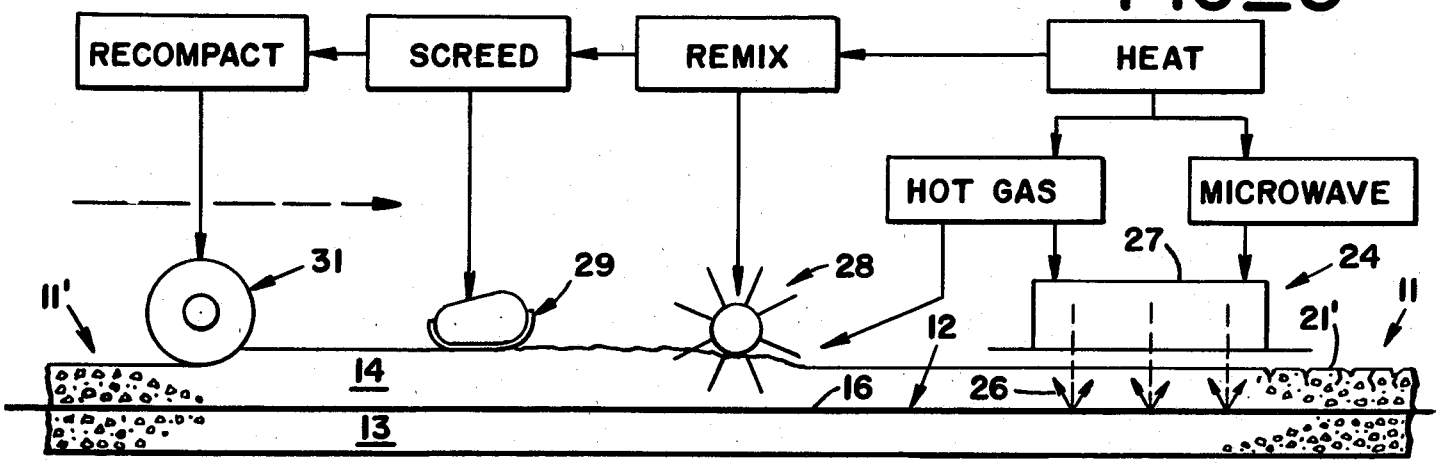
FIG. 3 is a diagrammatic illustration of successive steps of a pavement resurfacing method in accordance with another embodiment of the invention.

Referring now to FIG. 3, such resurfacing in many cases requires heating and remixing of only the deteriorated upper portion 21' of the pavement 11 to depths which do not usually exceed about 5 inches (13 cm) and which may often be less than that. The reflective zone 12 enables very substantial energy and cost savings under such circumstances by avoiding unnecessarily deep microwave heating of underlying material.

Resurfacing may, for example, be accomplished by using the methods and apparatus disclosed in my hereinbefore identified prior U.S. Patents such as U.S. Pat. No. 4,319,856. Thus a microwave applicator 24 may be positioned over the deteriorated pavement 11 in order to direct microwave energy 26 downwardly into the pavement. A portion of such energy 26 is absorbed and converted to heat during the initial downward passage through overlayer 14. The other portion of the energy 26 that penetrates unabsorbed through the overlayer 14 is wholly or largely reflected back upwardly by the conductive material 16 of zone 12 depending on the configuration of the material as will hereinafter be discussed in more detail.

If the reflective zone 12 is situated at or below one half of the maximum penetration distance of microwave energy into the paving material, then the reflected or returned energy is fully absorbed in the overlayer 14 before reaching the surface of the pavement 11. If the zone 12 is above that level, than a portion of the returned energy 26 emerges from the pavement 11 surface and propagates back to the applicator 24. As the applicator 24 is formed of electrically conductive material 27, such energy is again reflected and re-enters the overlayer 14. Such reflections between zone 12 and applicator 24 continue until the energy 26 has been substantially fully absorbed in the overlayer. In either case, the effect of zone 12 is to concentrate or localize the microwave heating in the overlayer 14 as opposed to the underlayer 13.

As described in my previously identified prior patents, microwave heating along causes a relative underheating of the immediate surface region of a pavement 11. This is believed to be due to exposure to cool ambient air or to the cooling effect of evaporating moisture which has been driven to the pavement 11 surface by the microwave heating. This may be counteracted by directing hot gas to the pavement 11 surface to supplement the microwave heating at the pavement surface. In instances where equipment used in the resurfacing method includes fuel consuming engines, substantial economies may be realized by using the hot exhaust gases of such engines for the supplemental heating.

Following heating of the overlayer 14 to a temperature at which the asphalt or other binder becomes liquid or semi-liquid, the material of the overlayer may be reworked if necessary such as by remixing or scarification or the like. Remixing, for example, may be done in place with a rotary tiller 28 or the like or the material may be temporarily lifted from the pavement 11 for remixing in a drum mixer or the like. It is usually advantageous to further heat the material with hot gas or by other means during remixing. The material may then be profiled with a screed 29 or other suitable device and is then recompacted with a roller 31 or other form of compaction device.

The above described resurfacing steps may be performed in sequence at a particular location or the operations may progress continuously along a length of deteriorated pavement 11. The equipment used in the practice of the method, such as microwave applicator 24, tiller 28, screed 29 and roller 31 or their equivalents may be of known form and may be either separate units of equipment or may be integrated into a single vehicle as described in my prior U.S. Pat. No. 4,319,856.

While the method of FIG. 3 has been described with respect to a complete resurfacing of a deteriorated pavement 11, it should be recognized that a similar sequence of operations may be performed at relatively small localized areas of such a pavement to repair potholes, specific cracks or the like. It should be recognized that a particular pavement 11 may be repeatedly resurfaced or repaired by such operations at intervals, typically of a number of years duration, as redeteriorations occur.

Figure 4:
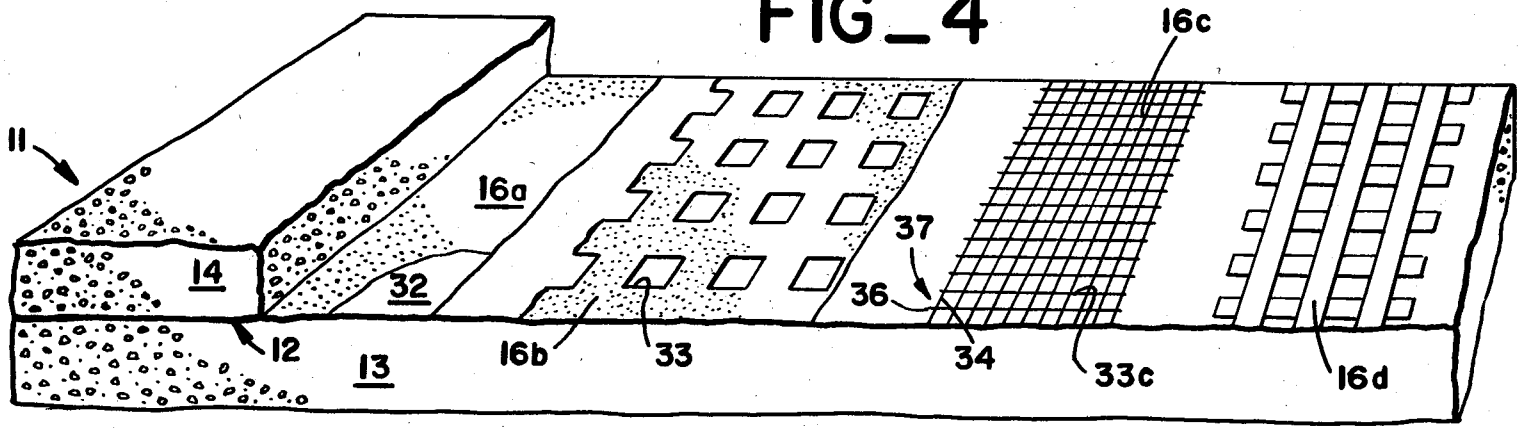
FIG. 4 is a broken out perspective view of a length of microwave energy concentrating pavement and depicts examples of suitable configurations for a microwave energy reflective zone within the pavement.

As has been pointed out, the reflective zone 12 may be defined by a continuous sheet of conductive metal which need not be thick and thus can be metal foil if desired. Any metals tend to be costly, particularly in the quantities needed to form large areas of energy concentrating pavement 11, it is advantageous to reduce the amount of metal that is used per unit area. For this purpose and to facilitate installation, with reference to FIG. 4, the conductive material **16*a* which forms the reflective zone 12 may be a very thin coat or plating of metal on a sheet 32 of flexible backing material such as polyethelene plastic among other examples. Techniques for adhering extremely thin layers of metal to flexible backing sheets are known to the art and are used, for example, in the manufacture of such products as wall coverings and food or gift wrapping papers. Coating methods of the particular kind which use non-conductive binder material to adhere metal particles together and to a backing may not, at least in some cases, exhibit adequate electrical conductivity and thus layers 16*a*** prepared by that particular procedure should be tested for conductivity or other procedures for forming a metal coating on backing material should be used.

The reflective zone 12 need not necessarily include a continuous or uninterrupted expanse of the conductive material **16*a*. An array of openings 33 including closely spaced apart openings may transpierce the conductive material 16*a* provided that the largest dimensions of such openings, taken in the plane of the zone 12, are small in relation to the wavelength of the microwave energy that is to be used to heat the pavement 11**. The full microwave spectrum includes frequencies from about 400 MHZ to about 300,000 MHZ corresponding to wavelengths from about 75 cm to about 0.1 cm. As a practical matter, current governmental regulations in most regions prescribe certain specific frequencies for industrial microwave equipment. The prescribed frequencies in the United States of America at this time are 915 MHZ and 2450 MHZ which have wavelengths of about 33 cm and 12 cm respectively.

Substantial savings in metal costs may be realized by providing such openings 33 and the openings may also be advantageous for other reasons. For example, a continuous sheet **16*a* of conductive metal prevents direct bonding between concretes which may be present in the underlayer 13 and overlayer 14. If openings 33 are provided and if such openings extend through any backing material 32 that may be present, such bonding can occur to provide a more integral, unitary pavement 11** construction.

While reflective zone 12 is intended to restrict microwave penetration into the pavement 11 during future repair operations and to concentrate heating into the overlayer 14, some limited heating of the adjacent portions of the underlayer 13 can be advantageous during some repair operations. Cooling of the overlayer 14 by heat transfer to the underlayer 13 is inhibited and bonding of the above-discussed kind is promoted. Such limited heating of the underlayer 13 can be arranged for by proportioning the openings 33 to transmit a limited amount of microwave energy.

Openings 33 through a thin expanse of conductor **16*b* do not transmit significant amounts of energy if the largest dimension of the opening is small in relation to the microwave wavelength. For example, openings 33** measuring 1.25 inch (3.18 cm) do not pass significant amounts of 915 MHZ microwave energy. Four inch (10.16 cm) openings transmit approximately 30% of such energy. A thin layer 16a of conductor having closely spaced openings measuring 5 inches (12.70 cm) is essentially non-reflective of microwave energy for the present purposes. Thus limited heating of underlayer 13 may be arranged for by proportioning the openings 33 to have maximum dimensions in the range from about 0.1 to about 0.3 of the wavelength, in the case of 915 MHZ microwave energy depending on the degree of heating that is desired. These approximate upper and lower limits each increase to a limited extent if the thickness of the conductive material 16a is itself increased.

The reflective zone 12 may be formed with still other configurations of conductive material such as by utilizing a metal mesh or screen 16c provided that it has openings 33c which meet the dimensional criteria discussed above. Such mesh or screen 16c should be of a type which is characterized by good electrical conductivity between intersecting metal components 34, 36 at the points 37 of intersection. As still another example, the reflective zone 12 may be a gridwork formed by applying strips of metal tape 16d to the surface of underlayer 13 in a pattern meeting the dimensional and electrical criteria discussed above.

It has been pointed out that different patterns of temperature rise within the overlayer 14, in response to microwave irradiation, may be arranged for by locating the reflective zone 12 at different depths or, in other words, by selecting the thickness of the overlayer for that purpose. In many cases, uniformity of heating within the overlayer 14 is most desirable. Referring now to FIG. 5A, highly uniform heating of the overlayer 14 may be provided for in most paving materials, where 915 MHZ microwave energy is used, by locating the zone 12 at a depth of about 2.5 inches (6.4 cm) below the pavement surface. Curve 38 in FIG. 5A depicts a typical heating pattern, in terms of temperature versus depth, that is produced in paving materials in the absence of a reflective zone 12 and in the absence of supplementary surface heating by hot gas or the like. It may be seen that heating is fairly uniform down to a depth of about 3 inches (7.6 cm). Heating then falls off at an increasingly rapid rate down to a depth of about 7.5 inches (19.1 cm) below which no significant heating occurs.

Location of a reflective zone 12 at a depth of about 2.5 inches (6.4 cm) or that vicinity produces a heating pattern 39 under which the maximum temperature variation between different portions of the overlayer material is about 12%. Reducing the thickness of the overlayer by shifting the reflective zone 12 closer to the pavement surface may produce an even more uniform temperature distribution but in some cases at least does not allow for reworking of the pavement to the most desirable depth.

The portion of curve 38 between points $X_0$ and $X_1$ in FIG. 5A represents the heating pattern produced by the microwave energy as it initially penetrates into the overlayer material. Curve 41 represents the additional contribution to the heating upon reflection from zone 12 and it should be noted that curve 41 corresponds to the portion of the basic heating curve 38 between points $X_1$ and $X_2$ thereon except that it is oppositely directed and the heating which it represents occurs in the overlayer rather than deeper in pavement. The portion of the microwave energy which is still unabsorbed then temporarily leaves the overlayer material but is returned by reflection from the microwave applicator as previously described and produces still another contribution to the overlayer heating that is represented by curve 42 in FIG. 5A. Except insofar as the heating occurs in the overlayer rather than deep within the pavement, curve 42 corresponds to the final portion $X_2$–$X_3$ of the basic heating curve 38. The final heating pattern 39 is the summation of curves 41, 42 and the portion of curve 38 which is between points $X_0$ and $X_1$.

A similar transpositioning of portions of the basic heating curve 38 can be used to determine the final heat-pattern where the reflective zone 12 is situated at other depths below the pavement surface and such other, less uniform, heating patterns may be preferred under certain circumstances. For example, FIG. 5B depicts the final heating pattern 39a with the reflective zone 12 at a depth of about 3.75 inches (9.5 cm) which is about one-half of the maximum penetration distance of microwave energy in typical paving material.

Figure 5B:
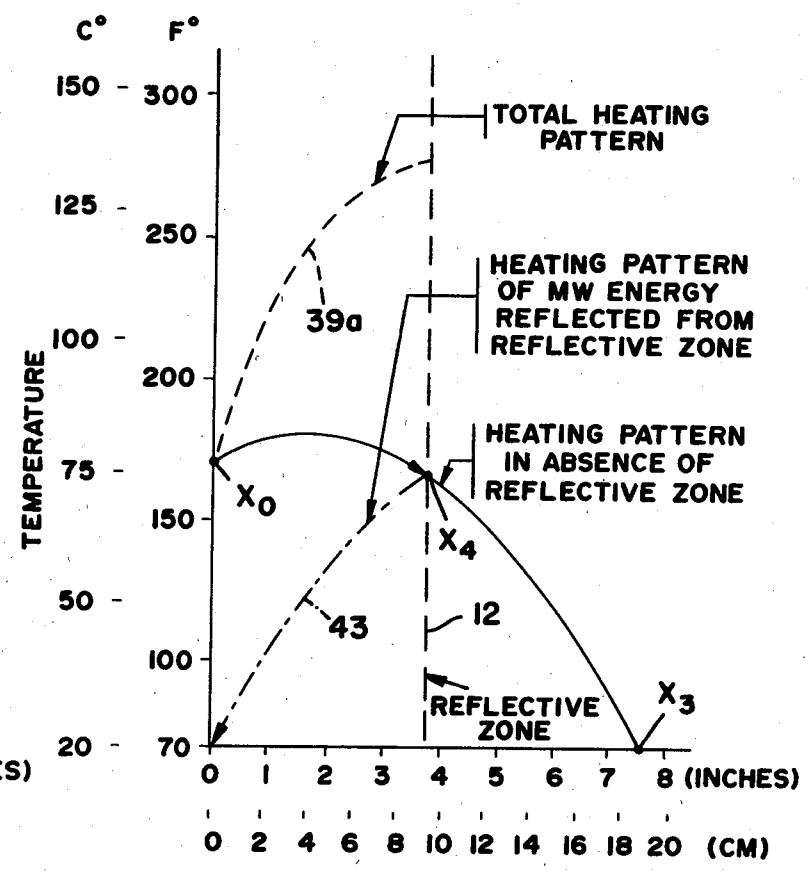
FIG. 5B is a graph depicting temperatures at successive depths which can be produced by microwave heating of a pavement embodying the invention wherein a microwave reflective zone is at a different depth below the pavement surface.
Figure 5A:
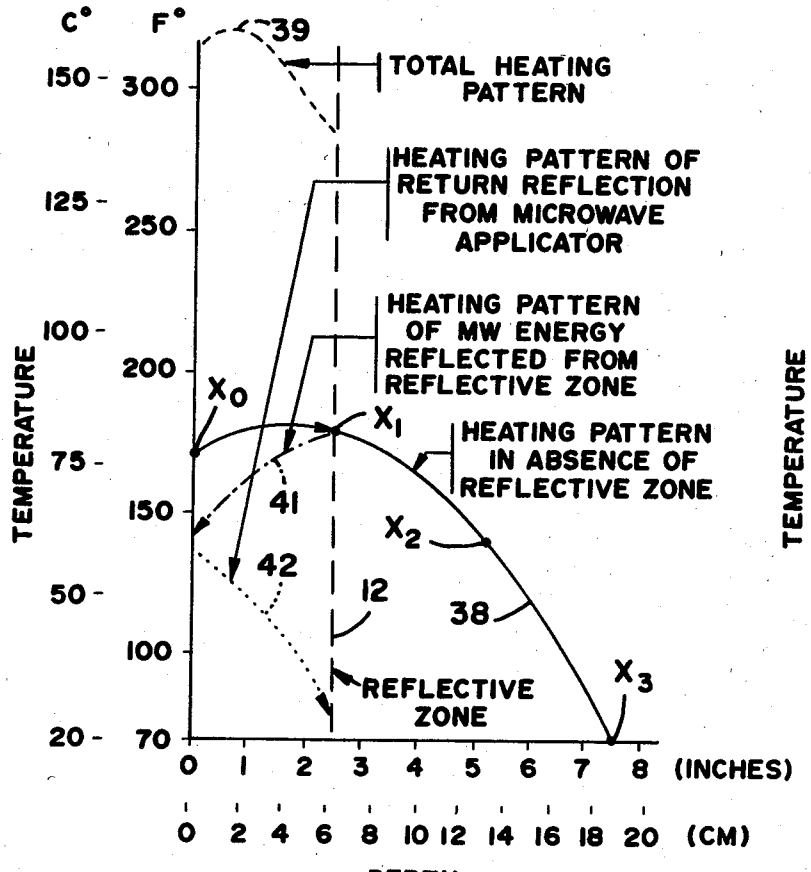
FIG. 5A is a graph depicting temperatures at successive depths which can be produced by microwave heating of a pavement embodying the invention wherein a microwave reflective zone is at a first distance below the pavement surface.

Portion $X_0$–$X_4$ of the basic heating curve 38 in FIG. 5B represents the contribution to heating of the overlayer made by the microwave energy during its passage into the overlayer. Curve 43 represents the additional contribution to heating made by the energy reflected from zone 12 and corresponds to the remaining portion, $X_4$–$X_3$, of the basic heating curve 38. The final microwave heating pattern 39a is the summation of curves $X_0$–$X_4$ and 43 and may be seen to produce a very non-uniform temperature rise. Temperatures increase markedly with depth and are highest in the vicinity of the reflective zone 12.

As increased degree of microwave heating at the deeper portions of the overlayer material may be advantageous under some conditions for several reasons. As previously pointed out, supplemental heat from hot gas or some other source may be applied to the pavement surface. Such supplemental heat does not penetrate very deeply in the time periods required for the microwave heating and thus overall uniformity of the combined heating may be enhanced by concentrating the microwave heating itself at deeper depths. Relatively high heating in the vicinity of the reflective zone 12 may also be desirable in the case of certain specialized forms of energy concentrating pavement an example of which is depicted in FIG. 6.

Figure 6:
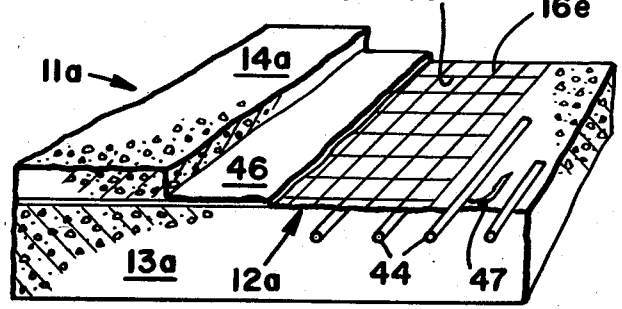
FIG. 6 is a broken out perspective view of another embodiment of the microwave energy concentrating pavement in which the heating pattern of FIG. 5B may be advantageously used to liquify internal sealant during repair operations.

The pavement 11a of FIG. 6 has a non-thermoplastic underlayer 13a formed, for example, of Portland cement concrete and which contains conventional reinforcement rods or rebars 44 which are typically steel. The microwave reflective zone 12a is situated just above the uppermost layer of rebars 44 and is of one of the forms which are transpierced by openings 33a, the conductive material 16e of the zone 12a being wire mesh in this particular example. Where a pre-existing Portland cement concrete pavement is to be utilized in the energy concentrating pavement 11a, an upper portion of the old concrete may be cold milled and removed in the manner previously described to expose the upper layer of rebars 44 and to enable emplacement of the zone 12a just above the rebars 44.

Prior to laying of the thermoplastic concrete overlayer 14a, an intermediate layer of thermoplastic sealant 46 is disposed over the reflective zone 12 and the overlayer 14a paving material is then deposited, screeded and compacted in the manner which has been previously described The sealant 46 may be asphalt, sulphur or other similar substances which can be melted by heat and which will then flow into adjacent cracks, crevices or the like and seal such openings against moisture intrusion upon hardening.

After deterioration has occured, the pavement 11*a* may be resurfaced by microwave and hot gas heating, followed by screeding and recompaction, in the manner hereinbefore described. In the course of such resurfacing, the microwave heating melts sealant 46 which may then flow through the openings 33*a* in zone 12*a* and seep into any cracks 47 or other openings in the adjacent portions of the Portland cement concrete underlayer 13*a* to inhibit further deterioration and to protect rebars 44 from moisture which can otherwise accumulate in such openings.

In some instances, a heating pattern of the type hereinbefore described with reference to FIG. 5B is advantageous during resurfacing of the form of pavement 11*a* depicted in FIG. 6. The resultant concentration of the microwave heating in the vicinity of zone 12*a* assures that the sealant 46 is fully melted and adequately heated. Such a heating pattern also makes it practical to employ sealants 46 having higher melting points than would otherwise be suitable. This kind of heating pattern can be provided by locating the reflective zone 12*a* at a depth in accordance with FIG. 5B or, in other words, at a depth of around 3.75 inches (9.5 cm) in most paving materials.

Figure 7:
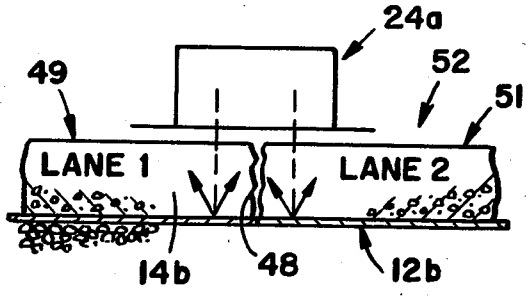
FIG. 7 is a cross section view of a portion of a roadway paved with asphaltic concrete and illustrating an application of an embodiment of the invention to the repair of a weak or deteriorated bond between adjoining lanes.

Repair operations on deteriorated pavements have been hereinbefore described primarily with respect to complete resurfacings of the pavements. The invention also facilitates repair of only specific portions of a pavement. Referring to FIG. 7, for example, the bond or juncture 48 between adjoining lanes 49 and 51 of an asphaltic concrete roadway 52 often deteriorates before the other portions of the roadway require repair. Such bonds 48 tend to be weak since such lanes 49 and 51 were often laid sequentially and thus the material of one lane may have hardened and may have had a different temperature at the time that the material of the other lane was laid. Repair of such a deteriorated bond 48 can be easily and economically effected if the lanes 49 and 51 are energy concentrating pavements of the hereinbefore described type which have a microwave reflective zone 12*b* below an overlayer 14*b* of thermoplastic concrete. The portions of the lanes 49 and 51 that are at and immediately adjacent the deteriorated bond 48 are heated with microwave energy from an applicator 24*a* and may then be scarified or remixed and be screeded and recompacted in the manner previously described to form a substantially stronger bond than may have originally been present.

Figure 8:
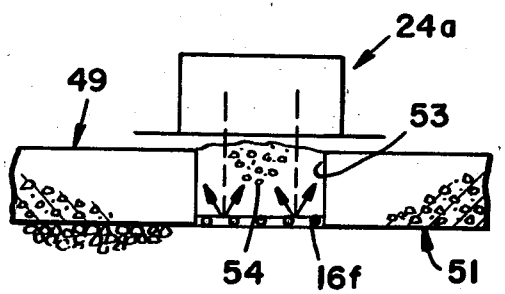
FIG. 8 is another cross section view of a portion of a roadway, which may be formed of either asphaltic or Portland cement concrete, illustrating a method of reconstruction of a pre-existing bond between adjoining lanes to enable future repair of the bond with concentrated microwave heating.

The process may be used to repair a deteriorated bond 48 in instances where the lanes 49 and 51 are not, initially, energy concentrating pavements having a microwave reflective zone 12*b*. The portions of the two lanes 49 and 51 that are in the immediate vicinity of the bond 48 may be removed by cold milling or other suitable techniques to form a slot 53 of at least several centimeters width as depicted in FIG. 8. Microwave reflective material 16*f* of one of the various forms that have been hereinbefore described is then placed along the bottom of the slot 53. The slot 53 is then filled with thermoplastic paving material 54 which may be the material that was removed to form the slot or which may be partially or wholly new material. The paving material 54 together with adjoining portions of the original lanes 49 and 51 may then be efficiently heated with microwave energy and hot gas from an applicator 24*a* as previously described. Remixing, screeding and recompaction of the heated material 54 then forms the lanes 49 and 51 into an essentially unitary pavement.

Figure 9:
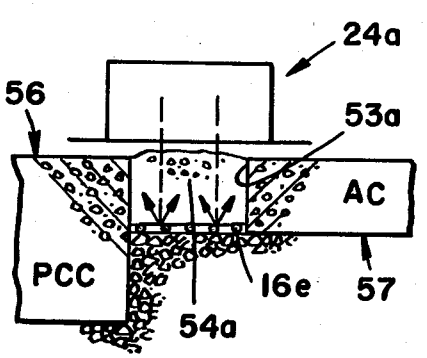
FIG. 9 is a cross section view of adjoining portions of a Portland cement concrete roadway and adjacent asphaltic concrete road shoulder and which illustrates a reconstruction which enables future repair of the juncture with concentrated microwave heating.

Referring now to FIG. 9, an essentially similar process may be used to repair a deteriorated bond between a Portland cement concrete roadway 56 and an adjoining, relatively thin asphaltic concrete road shoulder 57. In particular, a deteriorated portion of the shoulder 57 may be removed by cold milling or the like to form a slot 53*a* paralleling the Portland cement concrete roadway 56 and microwave reflective material 16*e* is then laid along the base of the slot. The slot 53*a* may then be filled with the removed material 54*a* or new thermoplastic paving material. Heating of the material 54*a* with a microwave applicator. 24*a*, followed by remixing, screeding and recompaction, produces a repaired joint between the roadway 56 and shoulder 57. Thereafter, the repair process may be repeated at intervals as becomes necessary, by reheating material 54*a* with microwave energy followed by scarifying or remixing and rescreeding and recompaction.

In addition to enabling a more efficient use of microwave energy in the repair operations, the method of FIG. 9 realizes still another benefit. Many thermoplastic concrete paving materials 54*a* can be abruptly and intensely heated with microwave energy to a degree that can cause cracking or spalling in Portland cement concrete 56. The method of FIG. 9 inherently corrects for this difference in tolerance to microwave heating. Energy propagating downwardly into the thermoplastic material 54*a* is concentrated in that material by the reflective zone 16*e* in the manner previously described. Downwardly propagating energy from the sides of applicator 24*a* that enters the Portland cement concrete 56 is not concentrated and penetrates more deeply until it is fully absorbed. Thus heating of the Portland cement concrete is less abrupt and of substantially smaller magnitude than the heating which occurs in the adjacent thermoplastic material 54*a*.

While the methods of FIGS. 7 to 9 have been described with respect to the repair of deteriorated regions which extend longitudinally along or adjacent a roadway, it should be recognized that similar procedures may be used to repair bonds, cracks or other deteriorated zones that extend transversely on the roadway.

Figure 10:
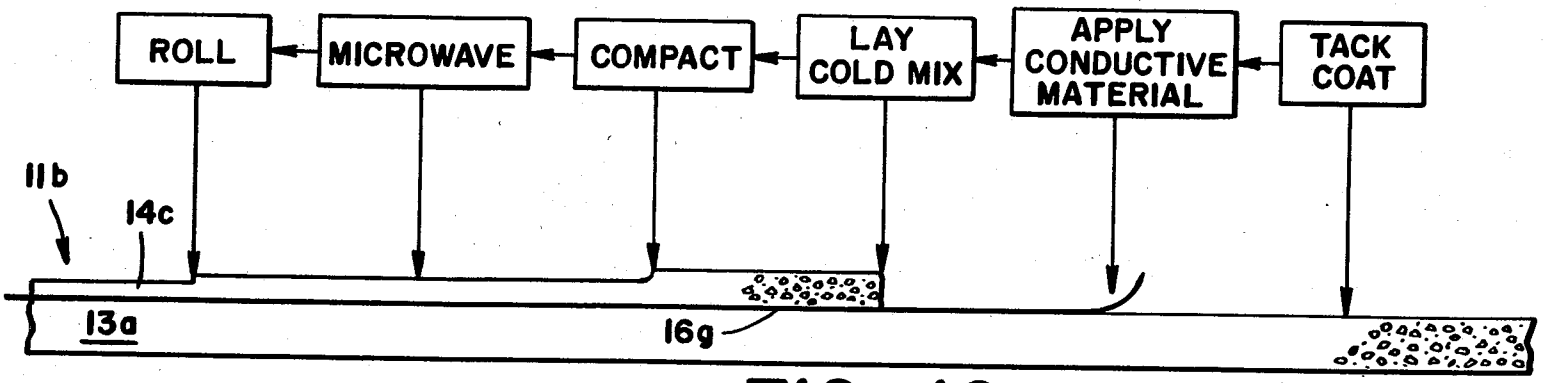
FIG. 10 is a diagrammatic illustration of successive steps in a method of accelerating the curing of emulsion based or cold mix pavements with concentrated microwave energy.

The invention has hereinbefore been described with respect to pavements and paving operations of the type in which the overlayer is formed of hot mix or heated thermoplastic material that solidifies and hardens upon cooling. Referring now to FIG. 10, the capability of concentrating microwave heating in an upper region of the pavement 11b is also highly advantageous where an overlayer 14*c* is formed of cold mix or thermoplastic material of the type containing a binder which emulsifies or polymerizes over a period of time to harden the concrete. While such cold mixes are designed to be laid in an unheated condition, the curing or hardening process can in fact be accelerated and improved by a mild degree of heating provided that such heating is fairly uniform throughout the volume of the curing material. This can be accomplished with microwave heating and, as in the previous embodiments of the invention, substantial cost savings can be realized if the microwave energy is prevented from penetrating more deeply into the pavement than is necessary.

The underlayer 13a may again be either a newly laid material of any of the types hereinbefore described or may be old pavement which is to be embodied into the energy concentrating pavement 11b. A tack coat of liquid asphalt or the like is preferably applied to the surface of underlayer 13a and conductive material 16g of any of the previously described forms is then laid in place on the underlayer. If the conductive material 16g is of one of the unperforated forms, another tack coat may be applied. The overlayer 14c of cold mix is then laid with a conventional paver vehicle or by other suitable means and may, in most cases, be given an initial compaction.

The overlayer 14c is then heated by directing microwave energy into the pavement in the manner previously described except that a lesser degree of such heating is usually appropriate. In a typical example, the overlayer 14c is heated to a temperature of about 140° F. (60° C.) although the preferred temperature for the purpose may vary considerably depending on the composition of the cold mix.

Following the microwave heating, which in some cases may be supplemented by the application of additional heat to the overlayer 14c surface, the pavement is again compacted and allowed to cure. Owing to the low thermal conductivity of paving materials, the internal temperature of the overlayer 14c remains elevated for at least a substantial portion of the curing period and thereby accelerates the curing process.

The pavement 11b may later be resurfaced or repaired by microwave heating, scarifying or remixing, and recompaction in the manner previously described with reference to FIG. 3 and the presence of the microwave reflective material 16g then again avoids a wastage of microwave energy from unnecessarily deep heating.

While the invention has been described with respect to certain specific embodiments, many variations are possible and it is not intended to limit the invention except as defined in the following claims.

I claim:

1. In a pavement which extends along a surface of the ground to form a roadway or the like thereon wherein at least an upper layer of the pavement that extends along said ground surface is formed of microwave absorbent thermoplastic paving material and wherein the material below said upper layer is also of a type into which microwave energy can pentrate, the upper layer having a thickness that is smaller than the maximum distance that microwave energy can penetrate into said paving materials, the improvement comprising:

a microwave energy reflective zone located between said upper layer and said lower material, said zone being defined by a relatively thin expanse of electrically conductive material between said upper layer and lower material and which has a configuration that will reflect at least a portion of downwardly propagating microwave energy back up into said upper layer.

2. The pavement of claim 1 wherein said expanse of electrically conductive material is situated at a depth from about five centimeters to about thirteen centimeters below the the surface of said pavement.

3. The pavement of claim 1 wherein said expanse of electrically conductive material has a plurality of spaced apart openings therethrough, said openings having maximum dimensions which are less than the wavelength of said microwave energy while being sufficiently large to transmit a limited portion of said downwardly propagating microwave energy down into the material below said microwave reflective zone.

4. The pavement of claim 1 wherein said electrically conductive material is a metal mesh in which the openings through the mesh have a maximum dimension smaller than the wavelength of said microwave energy.

5. In a pavement wherein at least an upper layer of the pavement is formed of microwave absorbent thermoplastic paving material and wherein the material below said upper layer is also of a type into which microwave energy can penetrate, the upper layer having a thickness that is smaller than the maximum distance that microwave energy can penetrate into said paving materials, the improvement comprising:

a microwave energy reflective zone located between said upper layer and said lower material, said zone being defined by a relatively thin expanse of electrically conductive material between said upper layer and lower material and which has a configuration that will reflect at least a portion of downwardly propagating microwave energy back up into said upper layer, said expanse of electrically conductive material having a plurality of spaced apart openings therethrough which openings have maximum dimensions that are less than the wavelength of said microwave energy while being sufficiently large to transmit a limited portion of said downwardly propagating microwave energy down into the material below said microwave reflective zone and wherein the material below said electrically conductive material is non-thermoplastic concrete, said pavement further including a layer of thermoplastic sealant material extending adjacent said conductive material.

6. In a pavement wherein at least an upper layer of the pavement is formed of microwave absorbent thermoplastic paving material and wherein the material below said upper layer is also of a type into which microwave energy can penetrate, the upper layer having a thickness that is smaller than the maximum distance that microwave energy can penetrate into said paving materials, the improvement comprising:

a microwave energy reflective zone located between said upper layer and said lower material, said zone being defined by a relatively thin expanse of electrically conductive material between said upper layer and lower material and which has a configuration that will reflect at least a portion of downwardly propagating microwave energy back up into said upper layer, said electrically conductive material being a relatively thin coating of metal adhered to a thicker backing of flexible non-conductive sheet material.

7. In a pavement wherein at least an upper layer of the pavement is formed of microwave absorbent thermoplastic paving material and wherein the material below said upper layer is also of a type into which microwave energy can penetrate, the upper layer having a thickness that is smaller than the maximum distance that microwave energy can penetrate into said paving materials, the improvement comprising:

a microwave energy reflective zone located between said upper layer and said lower material, said zone being defined by a relatively thin expanse of electrically conductive material between said upper layer and lower material and which has a configuration that will reflect at least a portion of downwardly propagating microwave energy back up into said upper layer and wherein said electrically conductive material includes intersecting strips of flexible metallic tape.

8. A microwave energy concentrating pavement forming a roadway or the like that extends along a surface of the ground comprising:

an underlayer formed of microwave absorbent paving material disposed at said ground surface, an expanse of electrically conductive metal disposed over said underlayer and having a configuration which will cause said conductive metal to reflect at least a portion of downwardly propagating microwave energy back in an upward direction, and an overlayer above said electrically conductive metal which is formed of microwave absorbent thermoplastic concrete and which has a thickness that is smaller than the maximum distance that microwave energy can penetrate into such thermoplastic concrete.

9. In a method of paving a roadway or the like that extends along a surface of the ground which includes the step of laying an overlayer of microwave absorbent thermoplastic paving material over an underlayer of roadway material that is also penetratable by microwave energy, the overlayer having a thickness that is less than the maximum thickness of said thermoplastic paving material that can be penetrated by microwave energy, the improvement comprising:

forming a microwave energy reflective zone between said thermoplastic overlayer and said underlayer of said roadway or the like that will reflect at least a portion of downwardly propagating microwave energy back up into said overlayer.

10. The method of claim 9 including the further step of forming said microwave reflective zone with spaced apart openings therethrough which are proportioned to transmit a limited portion of said microwave energy down into said underlayer.

11. The method of claim 9 including the further step of selecting the thickness of said overlayer to locate said reflective zone at a depth below the surface of said overlayer which will establish a predetermined pattern of temperature rise within said overlayer in response to said microwave energy.

12. The method of claim 9 including the further step of positioning said microwave reflective zone at a depth of from about five centimeters to about 13 centimeters below the top of said overlayer.

13. The method of claim 9 including forming said overlayer of asphaltic concrete cold mix and including the further step of accelerating curing of said cold mix by directing microwave energy downwardly into said cold mix.

14. The method of claim 9 including the further step of forming said microwave reflective zone by disposing electrically conductive material between said overlayer and said underlayer.

15. The method of claim 14 including the further step of arranging said electrically conductive material to reflect a first portion of downwardly propagating microwave energy back up into said overlayer and to transmit a second portion of said microwave energy downwardly into said underlayer.

16. In a paving method which includes the step of laying an overlayer of microwave absorbent thermoplastic paving material over an underlayer of non-thermoplastic concrete material that is also penetratable by microwave energy, the overlayer having a thickness that is less than the maximum thickness of said thermoplastic paving material that can be penetrated by microwave energy, the improvement comprising:

forming a microwave energy reflective zone between said overlayer and said underlayer that will reflect at least a portion of downwardly propagating microwave energy back up into said overlayer, including the further steps of providing said microwave energy reflective zone with spaced apart openings having maximum dimensions that are smaller than the wavelength of said microwave energy, and providing a layer of thermoplastic sealant adjacent said relective zone prior to laying said overlayer thereover.

17. The method of claim 16 including the further step of forming said overlayer to have a thickness of about one-half of said maximum thickness that can be penetrated by microwave energy whereby microwave heating will be more intense in the region of said sealant than in the upper region of said overlayer.

18. In a paving method which includes the step of laying an overlayer of microwave absorbent thermoplastic paving material over an underlayer of material that is also penetratable by microwave energy, the overlayer having a thickness that is less than the maximum thickness of said thermoplastic paving material that can be penetrated by microwave energy and wherein a deteriorated pre-existing pavement is utilized to form said underlayer, the improvement comprising:

forming a microwave energy reflective zone between said overlayer and said underlayer that will reflect at least a portion of downwardly propagating microwave energy back up into said overlayer, including removing an upper portion of said deteriorated pre-existing pavement, forming said microwave reflective zone by disposing electrically conductive material on the surface of the remaining portion of said deteriorated pre-existing pavement, the laying said overlayer over said electrically conductive material.

19. The method of claim 18 wherein said pre-existing pavement is a thermoplastic concrete including the further steps of heating and remixing the material of said removed upper portion thereof, and utilizing said heated and remixed material at least in part in said laying of said overlayer.

20. In a paving method which includes repaving of a joint between two pre-existing separately laid areas of pavement by laying an overlayer of microwave absorbent thermoplastic paving material over an underlayer of material that is also penetratable by microwave energy, the overlayer having a thickness that is less than the maximum thickness of said thermoplastic paving material that can be penetrated by microwave energy, the improvement comprising:

forming a microwave energy reflective zone between said overlayer and said underlayer that will reflect at least a portion of downwardly propagating microwave energy back up into said overlayer, including the further steps of removing material from at least one of said areas ofpavement to form a slot which extends along said joint and which has a depth less than said maximum thickness of thermoplastic paving material that can be penetrated by microwave energy, forming said microwave reflective zone by disposing electrically conductive material at the base of said slot, forming said overlayer by filling said slot with said microwave absorbent thermoplastic paving material, and compacting said thermoplastic paving material to reform said joint.

21. A paving method for a roadway or the like on a surface of the ground comprising the steps of:

preparing an underlayer of microwave absorbent roadway material, disposing an expanse of electrically conductive metal on the surface of said underlayer in a configuration that will reflect at least a portion of downwardly propagating energy back in an upward direction, laying an overlayer of microwave absorbent thermoplastic paving material over said electrically conductive metal including forming said overlayer to have a thickness that is smaller than the maximum distance to which microwave energy can penetrate into such thermoplastic paving material, and profiling and compacting said thermoplastic paving material to form a microwave energy concentrating pavement at said ground surface which can be economically resurface at intervals by microwave heating of said overlayer followed by reprofiling and recompaction thereof.

22. The method of claim 21 including the further step of subsequently repairing at least a portion of said pavement by directing microwave energy into said overlayer to decompose said overlayer, remixing the decomposed overlayer material, and recompacting the remixed material.

23. A method of repairing roadway pavement or the like that extends along a surface of the ground wherein at least the upper portion of said pavement is microwave absorbent thermoplastic concrete and wherein the material below said upper layer is also penetratable by microwave energy, comprising the steps of:

directing microwave energy downwardly into said roadway pavement to generate heat therein, concentrating the heating within an upper layer of said pavement by reflecting at least a portion of said microwave energy back upwardly at a predetermined depth below the surface of said pavement which depth is smaller than the maximum distance that microwave energy can penetrate into thermoplastic concrete, and subsequently recompacting the heated material of said upper layer of said pavement against said underlayer and ground surface.

* * * * *

UNITED STATES PATENT AND TRADEMARK OFFICE

CERTIFICATE OF CORRECTION

PATENT NO. : 4,594,022

DATED : June 10, 1986

INVENTOR(S) : Morris R. Jeppson

It is certified that error appears in the above—identified patent and that said Letters Patent is hereby corrected as shown below:

Column 4, line 26, "or" (second occurrence) should be --of--

Column 7, line 28, "along" should be --alone--

Column 8, line 7, "Any" should be --As--

Column 16, line 14 (claim 16, line 18), "relective" should be --reflective--

Column 16, line 40 (claim 18, line 19), "the" should be --and--

Column 17, line 22 (claim 21, line 18), "resurface" should be --resurfaced--

Signed and Sealed this

Twenty-eighth Day of October, 1986

[SEAL]

*Attest:*

DONALD J. QUIGG

*Attesting Officer* *Commissioner of Patents and Trademarks*